United States Patent [19]

Papenbrock et al.

[11] Patent Number: 4,852,308

[45] Date of Patent: Aug. 1, 1989

[54] GUTTER ASSEMBLY WITH CLEANING SYSTEM

[76] Inventors: Francis X. Papenbrock, 104 Shawnee Rd., Ardmore, Pa. 19003; Glenn C. Holcombe, 1155 S. Lehigh Cir., Swarthmore, Pa. 19081

[21] Appl. No.: 254,302

[22] Filed: Oct. 6, 1988

[51] Int. Cl.[4] ..... E04D 13/00

[52] U.S. Cl. ..... 52/12; 15/236.04

[58] Field of Search ..... 52/11, 12, 94; 248/48.1, 48.2; 210/474; 15/236.04

[56] References Cited

U.S. PATENT DOCUMENTS

| | | | |
|---|---|---|---|
| 2,469,841 | 5/1947 | Ours | 210/474 |
| 2,841,100 | 7/1958 | Moller | 52/12 |
| 3,292,198 | 12/1966 | Perkel | 15/236.04 |
| 3,977,135 | 8/1976 | Hunley, Jr. | 52/12 |
| 4,061,151 | 12/1977 | Ward | 52/11 |
| 4,241,547 | 12/1980 | Bove | 52/11 |
| 4,253,281 | 3/1981 | Ruttenberg | 52/12 |
| 4,406,093 | 9/1983 | Good et al. | 52/11 |
| 4,407,097 | 10/1983 | Allen | 52/11 |
| 4,542,553 | 9/1985 | Cary | 15/236.04 |
| 4,709,516 | 12/1987 | Gleaves | 52/11 |
| 4,745,709 | 5/1988 | Johnson | 52/11 |
| 4,807,406 | 2/1989 | Densmore | 52/12 |

*Primary Examiner*—James L. Ridgill, Jr.

*Attorney, Agent, or Firm*—Calfee, Halter & Griswold

[57] ABSTRACT

A gutter assembly with a cleaning system which facilitates the removal of debris from the channel member of the assembly. In one preferred embodiment the assembly comprises a longitudinally extending elongated channel member having an inner sidewall, an outer sidewall, and a horizontally extending bottom wall connecting and spacing the inner and outer sidewalls. A first removable end cap is located at one end of the channel member and a second end cap is located at the other end of the channel member. A flexible strip is disposed along the length of the bottom wall. One end of the flexible strip is connected to the removable end cap. The other end of the flexible strip is connected to a length of rope. The rope is guided along the length of the gutter assembly by a plurality of ring bolts. When a user removes the removable end cap the flexible strip is simultaneously removed from the confines of the channel member and any debris which has accumulated on the strip is also removed. The strip is repositioned within the channel member by pulling upon the loose end of the rope until the removable end cap is in the proximity of the end of the channel member. The removable end cap is then attached to the end of the channel member and the loose end of the rope is wrapped around a cleat located on the end cap and stored.

17 Claims, 7 Drawing Sheets

GUTTER ASSEMBLY WITH CLEANING SYSTEM

DISCLOSURE

This invention relates to a gutter assembly for use in conjunction with a structure having a roof. More particularly, the present invention relates to a gutter assembly having a cleaning system which facilitates the removal of debris from the channel member of the assembly.

BACKGROUND

Gutter assemblies are commonly mounted along the edge of a roof to receive rainwater from the roof and direct the rainwater to a downspout which facilitates the removal of the water from the proximity of the building or structure supporting the roof. Generally, such gutter assemblies include open-topped channel members. These channel members tend to accumulate leaves, twigs, degraded roofing material and other like debris. The debris restricts the flow of rainwater within the channel member resulting in the blockage or clogging of the gutter assembly and/or downspout. Once a blockage develops, the debris has to be cleared from the channel member so as to render it operational. Depending upon the environment in which the gutter assembly is located, such as in the proximity of trees, the gutter assembly may have to be cleared on a regular basis to prevent clogging or blockage.

The prior art provides various devices for cleaning debris from a gutter assembly. Some of these prior art devices have the cleaning system incorporated or integrated into the gutter assembly. An example of such a system may be found in Ruttenberg U.S. Pat. No. 4,253,281 which discloses a debris removal device having a movable, mesh-like conveyor belt covering the open, top end of the channel member which is adapted to transport debris longitudinally toward one end of the gutter assembly for collection and removal. Another example of such device may be found in Johnson U.S. Pat. No. 4,745,709 which discloses a gutter assembly having a channel member with a flexible liner member mounted therein. The channel member is cleared by pumping air between the liner and channel member. The air causes the liner to balloon up out of the channel member pushing the debris which has collected on the liner out through the top of the channel member.

SUMMARY OF THE INVENTION

The present invention provides a gutter assembly with a cleaning system which facilitates the easy removal of debris that accumulates in the channel member of the gutter assembly. The cleaning system is self-contained and requires no extraneous tools or materials to operate. The cleaning system provided by the present invention is also easily integrated into a variety of conventional gutter systems.

The gutter assembly made in accordance with the present invention comprises a longitudinally extending elongated channel member having an inner sidewall, an outer sidewall, and a horizontally extending bottom wall connecting and spacing the inner and outer sidewalls. A first removable end cap is located at one end of the channel member and a second end cap is located at the other end of the channel member. A flexible strip is disposed along the length of the bottom wall and means are provided to remove and reinsert the strip through one end of the channel member. As the strip is being removed from the channel member, the debris which has collected in the channel member and on the strip is removed or cleared from the gutter assembly.

In one preferred embodiment the means to remove and reinsert the strip comprises a hook connecting the removable end cap to the strip and a rope assembly. The rope assembly includes a rope having a length which is at least twice the horizontal length of the channel member. The rope is secured at one end to the distal end of the flexible strip opposite the end which is attached to the removable end cap and is guided by various ring bolts provided along the length of the gutter assembly. More particularly, a pair of ring bolts are positioned on the inside of the fixed end cap and a ring bolt is provided intermediate the ends of the channel member by a bracket. The bracket is secured to the channel member at one end by a clip that frictionally engages the inner wall of the channel member and at the other end by a downturned flange which fits securely within the slot formed by the vertical section, flange, tab and curved portion located at the top of the outer wall of the channel member. Mounted on the removable end cap is a cleat which facilitates the storage of the loose end of the rope on the gutter assembly.

When a user wants to clear accumulated debris from the channel member, a user unwinds the rope from the cleat, removes the end cap and pulls the end cap down or away from the channel member. Pulling upon the end cap results in the flexible strip sliding along the bottom wall and out of the confines of the channel member. Simultaneously therewith, debris which has accumulated in the channel member and on the strip is removed from the channel member.

The flexible strip is returned back into position within the confines of the channel member by pulling on the loose end of the rope which causes the flexible strip to slide along the bottom wall into the channel member. The rope is pulled on until the removale end cap is positioned in the immediate proximity of the end of the channel member. The removable end cap is then pushed back on to the end of the channel member so that it securely engages the end of the member and the loose end of the rope is then stored by wrapping it around the cleat.

In another preferred embodiment the means to remove and reinsert the strip comprises a counterweight assembly attached to each end of the flexible strip. Each of the counterweight assemblies comprises a counterweight and a rope connecting the counterweight to the respective end of the strip. A hook is provided at one end of the ropes and it allows the ropes to be attached and detached from the end of the strip. The counterweight assemblies are located within the downspouts at the ends of the channel member. The flexible strip lies along the bottom wall of the channel member between the openings for the downspouts. Each end of the flexible strip includes an upturned lip which helps to prevent debris from washing off the ends of the strip.

When a user wants to clear accumulated debris from the channel member, a user removes the end cap from one end of the channel member, detaches the counterweight assembly from the end of the flexible strip and attaches it to the channel member, and pulls the flexible strip out of the confines of the channel member causing the strip to slide along the bottom wall and out from the confines of the channel member. Simultaneously therewith, the debris which has accumulated on the flexible strip is removed from the channel member. The user proceeds to pull on the end of the strip until the counterweight assembly attached to the other end of the strip reaches the top of the downspout in which it is located. The user then discontinues pulling on the end of the strip and the counterweight assembly attached to the other end of the strip pulls the strip back into the confines of the channel member. The user then attaches the counterweight assembly to the strip and replaces the end cap. This procedure cleans out about one-half of the channel member.

In order to clean the other half of the channel member, the user repeats the aforementioned procedure on the other end of the strip. Specifically, the user removes the end cap from the other end of the channel member and detaches the counterweight assembly attached to such end of the strip and attaches it to the channel member. The user then pulls the other end of the strip out of the confines of the channel member causing the strip and the debris accumulated thereon to slide out the open end of the channel member. The user then discontinues pulling on the other end of the flexible strip and the counterweight assembly mounted at the first end of the flexible strip pulls the strip back into the confines of the channel member. The counterweight assembly which is attached to the channel is then attached to the flexible strip and the end cap is replaced on the end of the channel member.

The foregoing and other features of the invention are hereinafter more fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF PREFERRED EMBODIMENT

Figure 1:
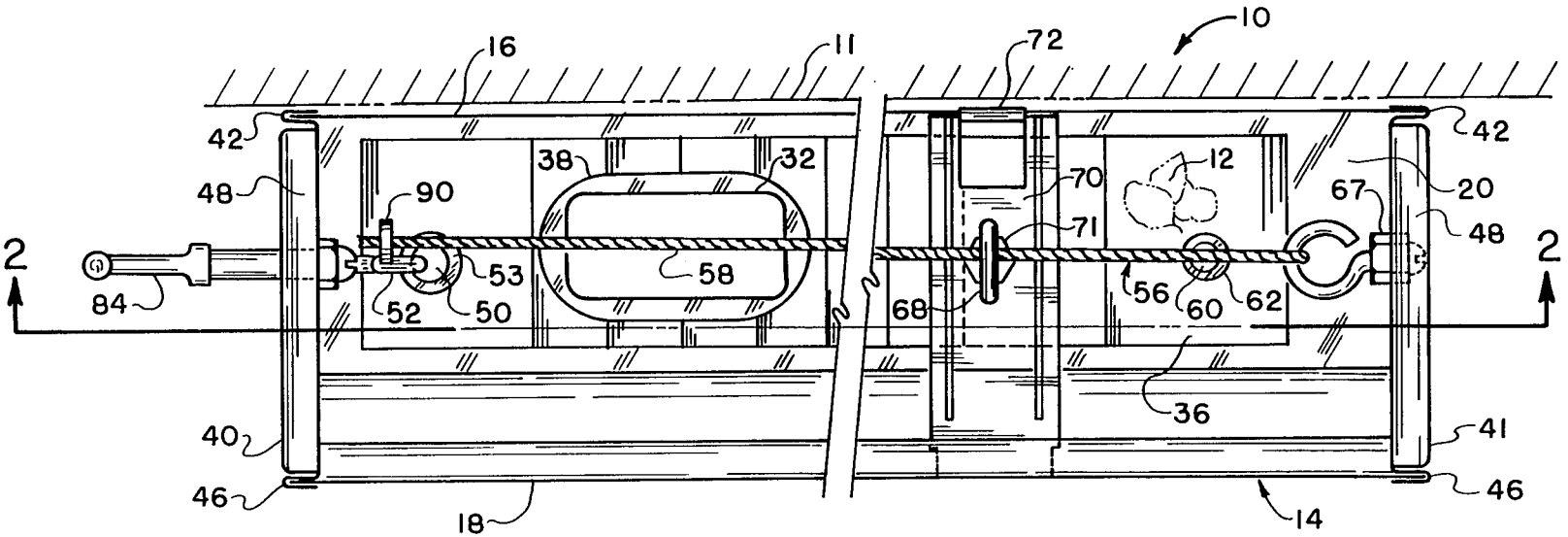
FIG. 1 is a top plan view of the gutter assembly made in accordance with the present invention with the loose end of the rope broken away.
Figure 2:
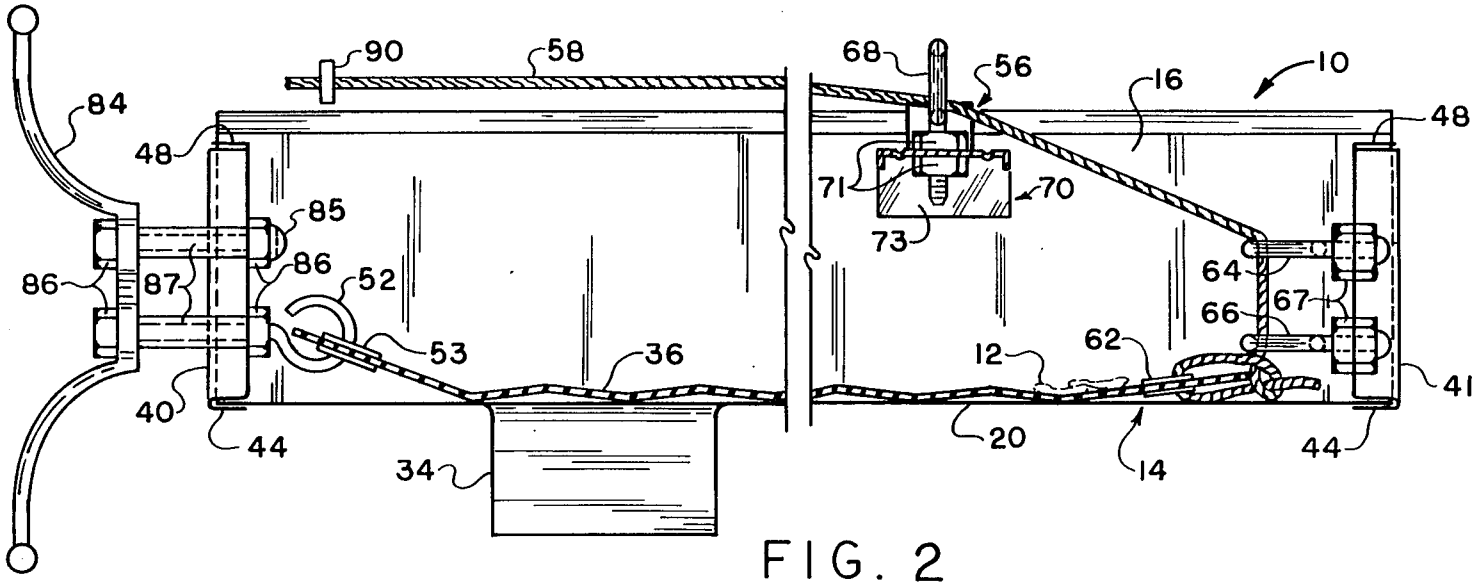
FIG. 2 is a side cross-sectional plan view of the gutter assembly shown in FIG. 1 taken along line 2—2 thereof.

Referring to the drawings, and initially to FIGS. 1 and 2, there is illustrated a gutter assembly 10 made in accordance with the present invention for mounting along the edge of a roof 11 (schematically illustrated) which facilitates the quick and easy removal of debris such as tree leaves 12 (shown in phantom) that tend to accumulate within the confines of the gutter assembly 10.

Figure 3:
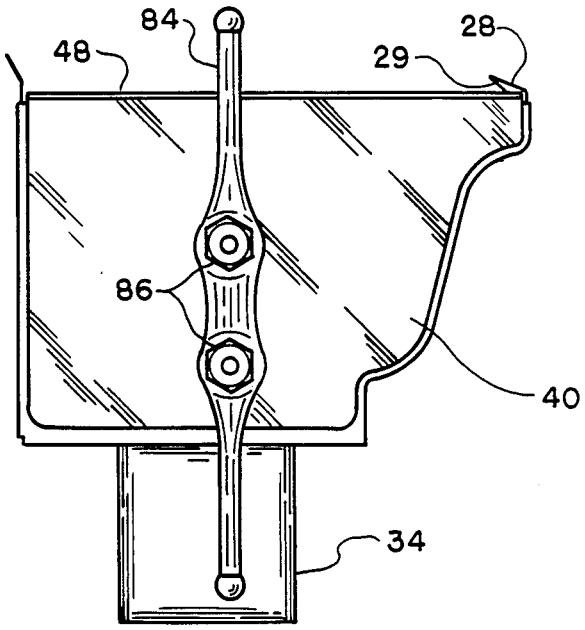
FIG. 3 is an end view of the gutter assembly of FIG. 1.
Figure 7:
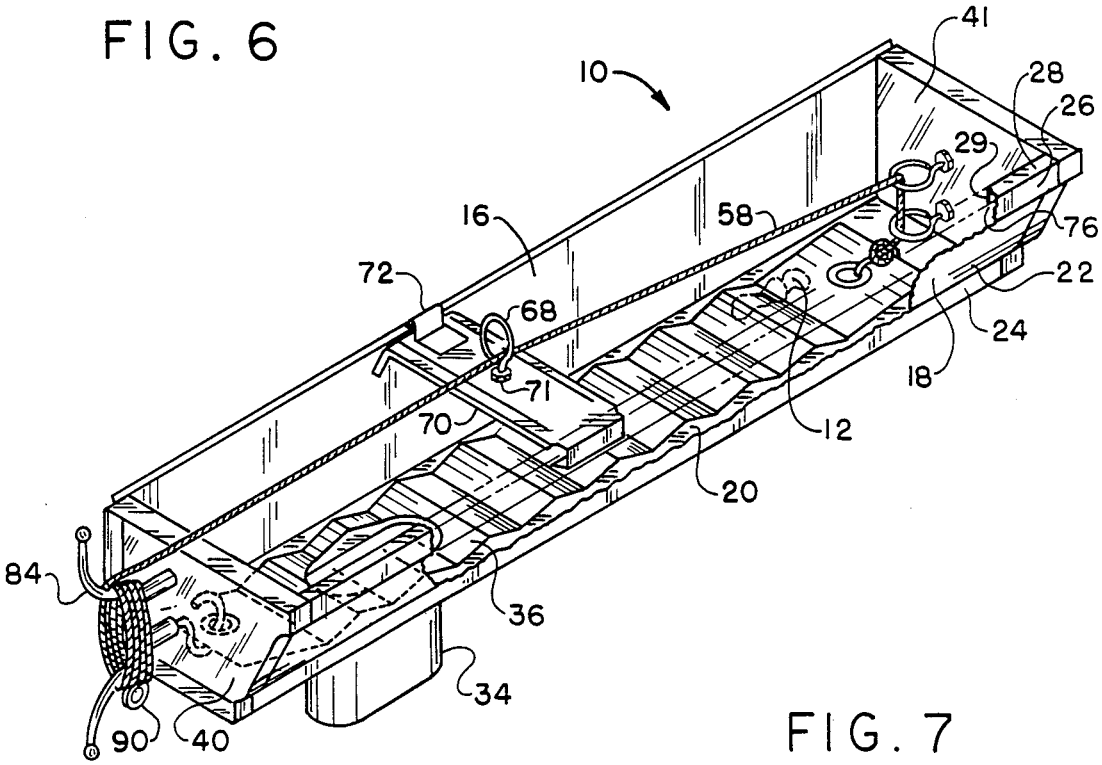
FIG. 7 is a schematic perspective view of the gutter assembly of FIG. 1 with the flexible strip in its normal or inserted position.

Gutter assembly 10 includes a longitudinally extending channel-shaped member 14 having an upright inner wall 16, an upright outer wall 18, and a bottom wall 20 which spaces and connects the inner wall 16 and the outer wall 18. Inner wall 16 and bottom wall 20 are straight and they extend perpendicular to one another. Outer wall 18 extends substantially perpendicular to bottom wall 20 and it includes, as shown in FIGS. 3 and 7, a curved central portion 22, a pair of vertically extending sections 24 and 26, and a horizontally extending flange 28 having an inwardly curled tab 29.

Channel member 14 serves to collect the rainwater and debris that flows off the edge of the roof 11. At one end of the channel member 14 there is provided an opening 32 and a downspout 34 which permits the water collected in the channel member 14 to flow therefrom.

Disposed along the length of the bottom wall 20 of the channel member 14 is a flexible strip 36 having a width which is slightly less than the width of the bottom wall 20. Preferably, strip 36 comprises a lightweight corrugated aluminum or a flexible plastic strip. If a plastic strip is employed, preferably such plastic strip should be resistant to sunlight and weathering. However, it will be appreciated that the present invention contemplates the use of a low cost disposable strip (which may be furnished in rolls and may be mounted and stored upon the gutter assembly) that may be made of a plastic, paper or cloth that can withstand only a limited amount of exposure or weathering. Strip 36 sets on or lies substantially contiguous with the bottom wall 20 and the debris 12 collects and deposits thereon. Provided at one end of strip 36 is an opening 38 which permits the flow of water through opening 32 in bottom wall 20 and to the downspout 34.

Figure 4:
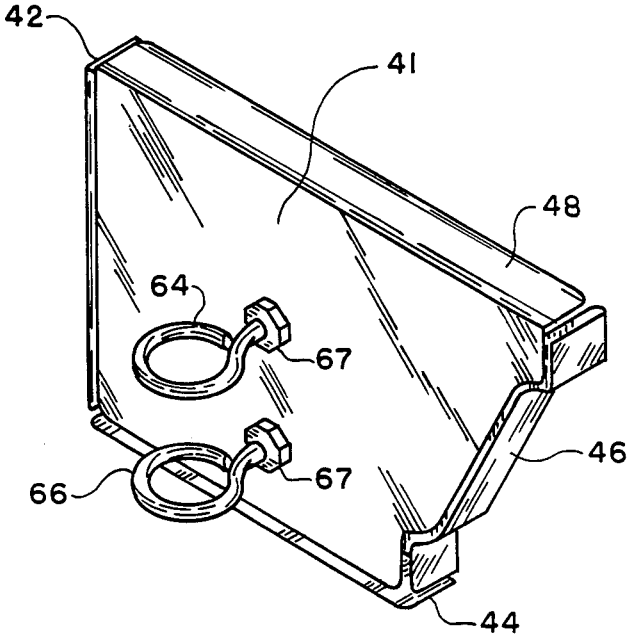
FIG. 4 is a perspective view of the fixed end cap.

Located at the distal ends of the channel member 14 are end caps 40 and 41. End caps 40 and 41 are mirror images of one another. As shown in FIG. 4, end caps 40 and 41 both include a series of three lips 42, 44 and 46 which frictionally engage respectively the inner wall 16, bottom wall 20 and outer wall 18 of the channel member 14 when the end caps are installed on the ends of the channel member 14. End caps 40 and 41 also include a horizontally extending flange 48 which deflects and frictionally engages the tab 29 extending along flange 28 of the channel member 14 as shown in FIG. 3. Preferably, end cap 41 is fastened to the end of the channel member 14 on a more permanent basis such as by multiple screws, rivets or glue. However, as discussed below, it is important that end cap 40 remain mounted in a frictionally engaged manner so that it can be fairly easily removed.

In order to facilitate the removal of the flexible strip 36, and thus the cleaning of debris 12 from the member 14, the end cap 40 is attached to one end of the flexible strip 36 at opening 50 by a threaded bolt hook 52 which is secured to the end cap 40. In order to ensure the secure attachment of the bolt hook 52 at opening 50, preferably opening 50 includes some form of reinforcement so as to prevent the tearing of the flexible strip 36. As illustrated, such means of reinforcement may comprise a rubber washer 53 secured to opening 50, for example, by a compression fit or glue.

In order to facilitate the return of the flexible strip 36 back into the channel member 14 after removal therefrom, there is provided a rope assembly generally indicated at 56. Rope assembly 56 includes a piece of rope 58 having a length which is preferably at least twice the horizontal length of member 14. Preferably, rope 58 is made of a material such as nylon or other like synthetic material which resists weathering and deterioration. Rope 58 is secured at one end to the distal end of the flexible strip 36. More particularly, rope 58 is tied off with a knot through an opening 60 provided in the flexible strip 36. Preferably, as shown, opening 60 also includes a reinforcing rubber washer 62 to prevent the tearing of the flexible strip 36.

Figure 5:
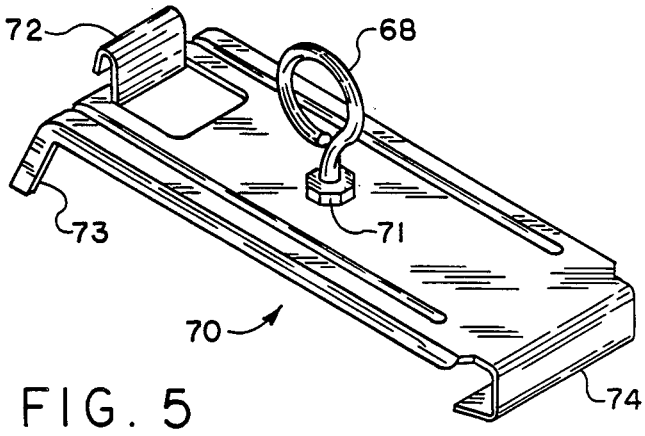
FIG. 5 is a perspective view of the bracket illustrated in FIG. 1.

Rope 58 is guided by providing various ring bolts along the length of the gutter assembly 10. Specifically, a pair of ring bolts 64 and 66 are fastened with clamping nuts 67 to the inside of end cap 41 and a ring bolt 68 is provided intermediate the ends of the channel member 14. Ring bolt 68 is positioned along the length of the channel member 14 by a bracket 70. As illustrated in FIGS. 2 and 5, ring bolt 68 is attached to bracket 70 with clamping nuts 71. Bracket 70 is secured to the channel member 14 at one end by a clip 72 that frictionally engages the top of inner wall 16 and a downwardly extending flange 73 which engages the inside surface of inner wall 16. The other end of the bracket 70 includes a downturned curled flange 74 which fits securely within the slot 76 (shown in FIG. 7) formed by the vertical section 26, flange 28, tab 29 and curved portion 22 at the top of the outer wall 18.

Figure 6:
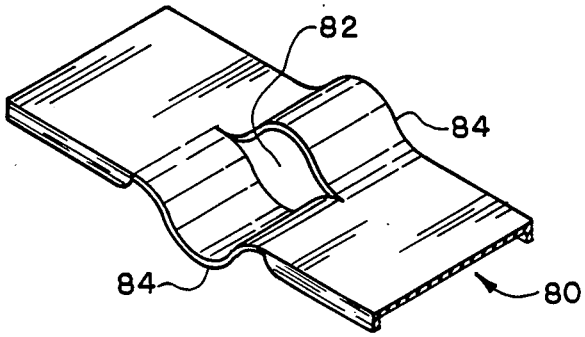
FIG. 6 is a perspective view of another bracket made in accordance with the present invention.

Referring now to FIG. 6, there is illustrated an alternate bracket 80 made in accordance with the present invention. Bracket 80 includes the same end fittings as bracket 70 to facilitate the attachment to the channel member 14, but it does not include a ring bolt 68 for guiding the rope 58. Instead, bracket 80 includes a passageway or cord guide 82 integrally formed therein by a pair of oppossed channels 84. It will be appreciated that in addition to the illustrated alternate bracket 80, the present invention contemplates and includes any one of a variety of brackets which could serve to guide the rope 58 including a bracket like bracket 70 having a ringbolt which extends vertically downward instead of upward (so as to create less resistance to snow or ice falling off of the roof), or a bracket with alternate means for mounting to a channel member (so as to facilitate the mounting of a bracket to channel members of different configuration). Additionally, it will be appreciated that a bracket which serves to guide rope 58 may be incorporated into the sleeves which cover the spikes or nails which are commonly used to mount a gutter assembly upon a roof. Furthermore, it will be appreciated that a number of ring bolts and brackets may be positioned along channel member 14 depending upon the length of the channel member 14.

Mounted on the outside surface of the end cap 40 is a cleat 84. Cleat 84 is attached to the end cap 40 with machine screw 85 and bolt hook 52 and nuts 86. Preferably, as shown spacers or sleeves 87 are provided which space the cleat 84 from the end cap 40. Cleat 84 serves to facilitate the storage of the loose end of the rope 58 upon the gutter assembly 10. More particularly, the loose end of rope 58 is stored by wrapping it multiple times around cleat 84. It will be appreciated that cleat 84 may be mounted at various locations instead of end cap 40 including, for example, on the outside of bottom wall 20, on outer wall 18, or on the top of bracket 70 if such bracket is located near the end of strip 36 in the proximity of end cap 40. Also, it will be appreciated that in addition to cleat 84, the present invention contemplates the use of other devices for storing rope 58 including, for example, a spring wound spool or hand crank.

Figure 8:
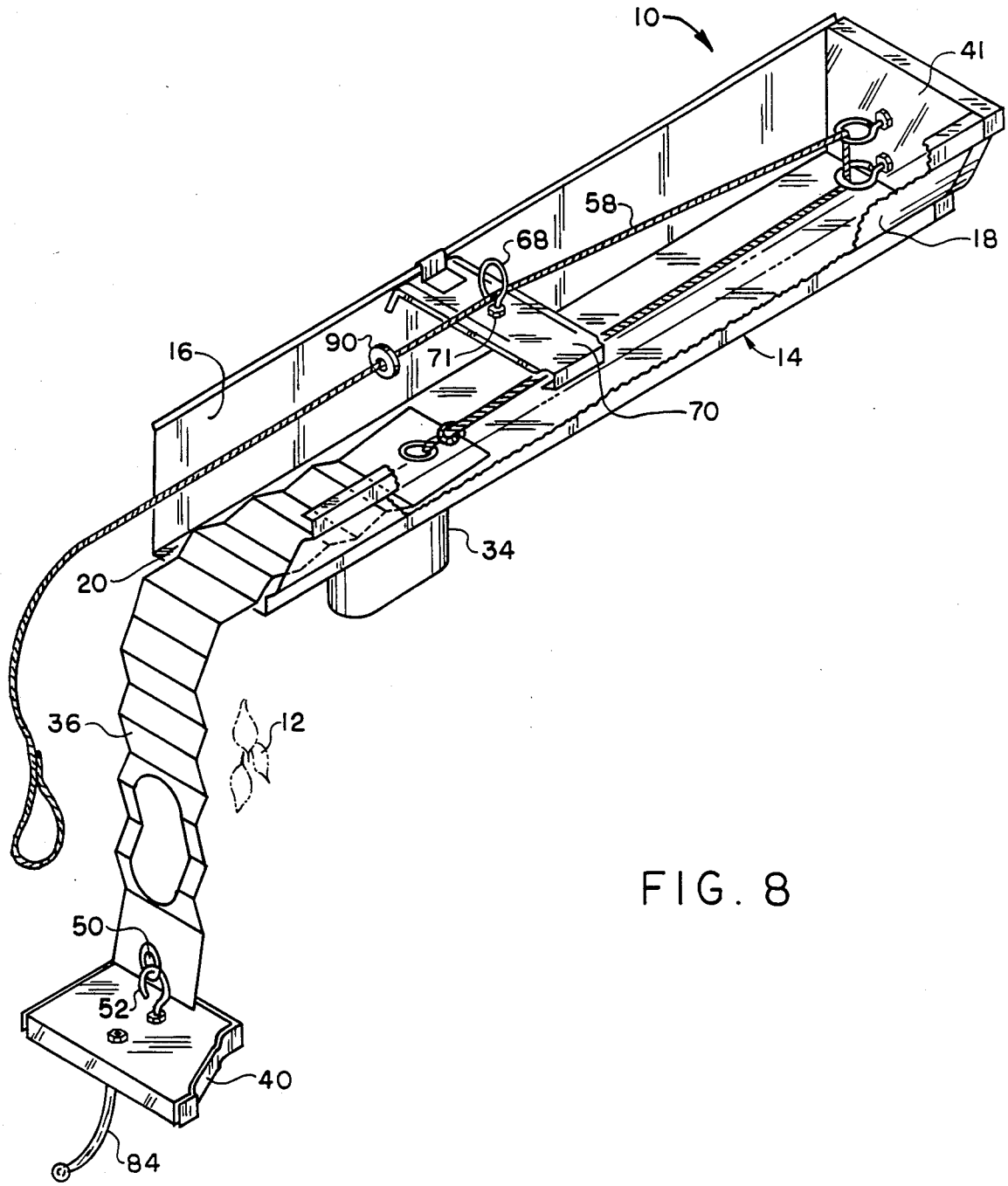
FIG. 8 is a schematic perspective view of the gutter assembly of FIG. 1 with the flexible strip in the removed position.

Referring now to FIGS. 7 and 8, the method by which gutter assembly 10 is utilized is clearly illustrated. More particularly, when a user wants to clear accumulated debris 12 from the channel member 14, the user unwinds the rope 58 from cleat 84, removes the end cap 40 and pulls the end cap 40 down or away from the channel member 14 as shown in FIG. 8. Pulling upon the end cap 40 results in the flexible strip 36 sliding along bottom wall 20 and the removal of the flexible strip 36 from the confines of the channel member 14. Simultaneously therewith, debris 12 which has accumulated in the channel member 14 and upon flexible strip 36 is removed from the confines of the channel member 14.

When the flexible strip 36 is pulled out of the channel member 14 the distal end of rope 58 is pulled into the channel member 14 behind the flexible strip 36. In order to prevent the flexible strip 36 from being pulled too far and thus out of the channel member 14, there is provided a travel restrainer 90. Travel restrainer 90 comprises a rubber washer which is secured to rope 58 by, for example, a pair of knots tied in rope 58 or by glue. In addition to producing the restrainer 90 from rubber, it will be appreciated that additional materials may be used such as plastic or a corrosion resistant metal. The restrainer 90 is of sufficient diameter that it engages the eye of ring bolt 68 and prevents the rope 58 from being pulled therethrough. Restrainer 90 is spaced along rope 58 such that the distance along rope 58 from the restrainer 90 to opening 60 is slightly shorter than the length of channel member 14.

After the flexible strip 36 has been removed its maximum extent and the debris 12 has been cleared from the confines of channel member 14, flexible strip 36 is returned back into position within the confines of member 14 by pulling on the loose end of rope 58 until end cap 40 is positioned in the immediate proximity of the end of the member 14. End cap 40 is then pushed back on to the end of the channel member 14 so that it securely engages the end of member 14 and then the loose end of the rope 58 is stored by wrapping it around cleat 84.

Although in the illustrated preferred embodiment of FIGS. 1-8 the rope assembly 56 has been provided to facilitate the return of the flexible strip 36 into the confines of the channel member 14, it will be appreciated that this invention contemplates alternate means to accomplish this function. For example, such alternate means may include a clock-spring type retraction system mounted at the distal end of the channel member 14 which imparts a biasing force that pulls the flexible strip into the confines of the channel member 14.

Figure 9:
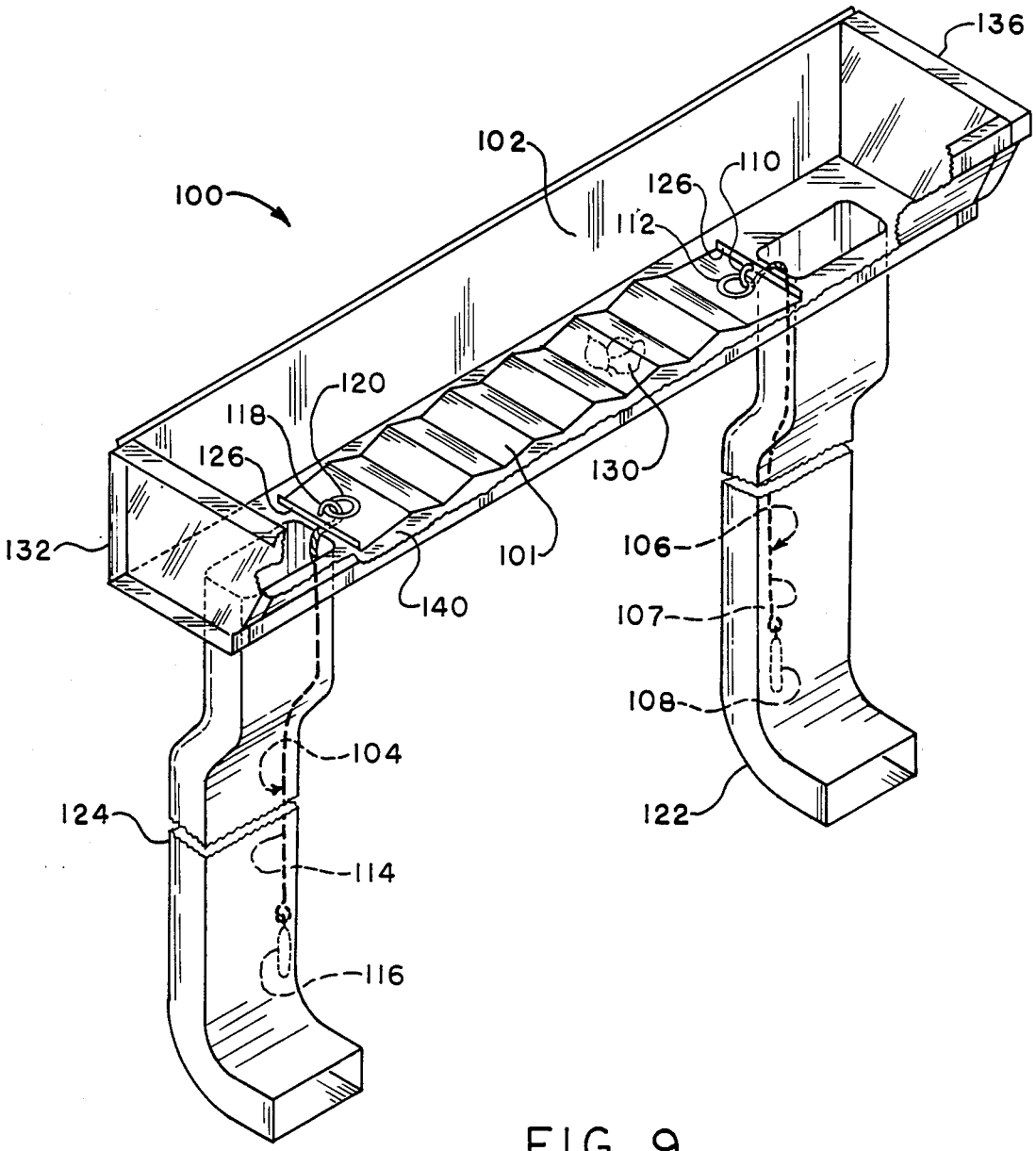
FIG. 9 is a schematic perspective view of an alternate preferred embodiment of a gutter assembly made in accordance with the present invention.
Figure 10:
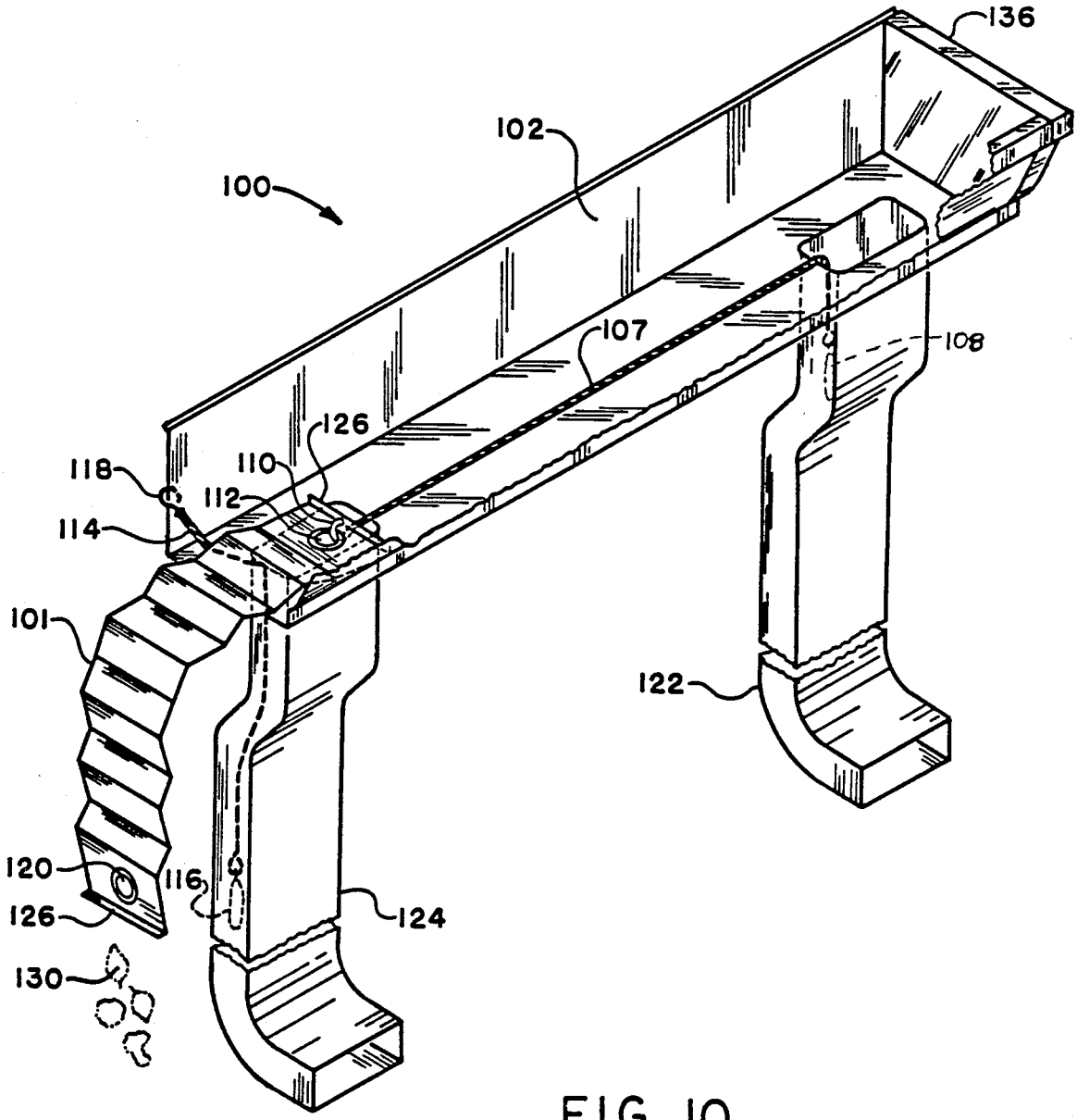
FIG. 10 is a schematic perspective view of the gutter assembly of FIG. 9 with flexible strip in the removed position.

Referring now to FIGS. 9 and 10 there is illustrated another preferred embodiment of a gutter assembly 100 made in accordance with the present invention which employs alternate means to facilitate the return of the flexible strip 101 into the confines of the channel member 102. Specifically, gutter assembly 100 employs counterweight systems 104 and 106 to facilitate the return of the flexible strip 101. Counterweight system 106 comprises a length of rope 107 attached at one end to counterweight 108 and at the other end to hook 110. Hook 110 is attached to the flexible strip 101 through reinforced opening 112 located at the end of the strip 101. Similarly, counterweight system 104 includes a length of rope 114 attached at one end to counterweight 116 and at the other end to hook 118. Hook 118 is attached through reinforced opening 120 located at the other end of the flexible strip 101.

Counterweights 108 and 116 are located respectively within the confines of downspouts 122 and 124. Counterweights 108 and 116 must be properly dimensioned so as to permit such counterweights to travel up and down within the downspouts 122 and 124. Also, counterweights 108 and 116 must be of sufficient weight that they can slide strip 101 along the bottom of channel member 102 when one of the counterweight assemblies is detached and they must be of equal weight so that the strip 101 remains stationary when both counterweight assemblies are attached.

Flexible strip 101 is essentially the same as flexible strip 36 illustrated in the embodiment of FIGS. 1-8 except it does not include any openings at its ends which open into downspouts 122 and 124. Also, flexible strip 101 includes a pair of upturned lips 126 which are located at the end of strip 101. Lips 126 serve to prevent debris from washing over the ends of the strip 101 and into downspouts 122 and 124. Preferably, as shown, lips 126 are of minimal height and they include tapered edges so as not to create a significant obstruction to the flow of water within the channel member 102.

As shown in FIG. 10, debris 130 is removed by removing removable end cap 132 from member 102, attaching hook 118 to the end of channel member 102, and sliding the end of the flexible strip 101 out the open end of channel member 102. As strip 101 is being pulled, counterweight 108 moves vertically up along downspout 122. Strip 101 may be pulled out until counterweight 122 reaches the top of downspout 122. Preferably, strip 101 is at the most twice the length of downspout 122. Thus, about one-half the length of strip 101 can be cleaned as it is slid out through the open end created in channel 102 when end cap 132 is removed. Once about half of the strip 101 has been removed and the debris 130 (shown in phantom) accumulated thereon is also removed, the user discontinues pulling on the end of the strip 101 and counterweight 108 then serves to pull strip 101 back into the position shown in FIG. 9. Hook 118 is then attached to opening 120 and end cap 132 is placed back on the end of channel member 102.

The remaining half of strip 101 is removed by repeating the same procedure specified above with respect to the first half. More particularly, removable end cap 136 is removed from the end of channel member 102 and hook 110 is attached to the end of channel member 102. Flexible strip 101 is then slid out the open end of the channel member 102 until counterweight 116 reaches the top of downspout 124. Once the other half of strip 101 has been removed and the debris accumulated thereon is removed, counterweight 108 serves to pull strip 101 back into the position shown in FIG. 9. Hook 110 is then attached to opening 112 and end cap 136 is placed back on channel member 102.

In addition to facilitating the return of the flexible strip 101 to its normal or operational position shown in FIG. 9, counterweights 116 and 108 serve to apply a continuous force on the ends of the flexible strip 101 which helps to retain strip 101 flat against the bottom wall 140 of channel member 102. Holding strip 101 in this position helps to prevent debris from working its way between the strip 101 and the bottom wall 140.

Although in the previously illustrated embodiment counterweight assemblies are shown on each end of strip 101, it will be appreciated that the present invention contemplates the use of a counterweight assembly on only one end of the flexible strip. Specifically, for gutter assemblies having channel members with a length which is no greater than the length of an associated downspout, it would be possible to slide the full length of the flexible strip 101 out through one end of the channel member. Thus, it would be possible to provide a gutter assumbly like that shown in FIGS. 9 and 10 having a counterweight assembly at only one end of the flexible strip 101. Also, it will be appreciated that in such a gutter assembly, it may be possible to attach or hook the end of the flexible strip which is not attached to a counterweight assembly to a removable end cap as illustrated in the embodiment of FIGS. 1-8.

Although the invention has been illustrated with channel members having a specific configuration that includes a straight inner wall and a curved outer wall, it will be appreciated that this invention contemplates a channel member having any one of a variety of configurations including straight inner and outer walls, or a semi-circular configuration which comprises an accurate bottom wall and very short vertically extending inner and outer walls. In the event that a channel member having an alternate configuration is employed, it will be appreciated that the flexible strip may have to be modified to ensure that it lies properly at the bottom of the channel member. More particularly, the flexible strip may have to be pre-shaped to conform to the bottom of the channel member or it may have to be constructed of a softer material so as to allow it to conform to the shape of the bottom of the channel member. It will also be appreciated that when an alternate shaped channel member is utilized, it may also be necessary to alter the shape and means by which the end caps are connected to the channel member. Also, it will be appreciated that the present invention contemplates the use of a channel member comprising multiple pieces or one continuous piece.

Furthermore, it will be appreciated that a gutter assembly made in accordance with the present invention may include elements constructed of a variety of materials including, for example, aluminum, steel, galvanized steel and plastic. Additionally, it will be appreciated that depending upon the particular type of materials utilized to construct the gutter assembly, it may be possible to integrally mold or extrude various elements of the assembly. For example, it may be possible to mold the end cap 41 and ring bolts 64 and 66, or the bracket 70 and ring bolt 68, as single pieces.

Although the invention has been shown and described with respect to preferred embodiments, it is obvious that equivalent alterations and modifications will occur to others skilled in the art upon reading and understanding this specification. The present invention includes all such equivalent alterations and modifications, and is limited only by the scope of the following claims.

What is claimed:

1. A gutter assembly comprising a longitudinally extending elongated channel member having an inner sidewall, an outer sidewall, and a bottom wall connecting and spacing said inner sidewall and said outer sidewall, a first end cap located at one end of said channel member and a second end cap located at the other end of said channel member, a flexible strip disposed along the length of said bottom wall, and means to remove and re-insert said strip through the one end of said channel member with a portion of said strip remaining in sliding contact with said bottom wall as said strip is being removed from the confines of said channel member.

2. A gutter assembly as set forth in claim 1 wherein said means to remove and re-insert includes a hook connecting one end of said flexible strip to said first end cap.

3. A gutter assembly as set forth in claim 2 wherein said means to remove and re-insert includes a rope assembly having a length of rope which is attached to the distal end of the flexible strip.

4. A gutter assembly as set forth in claim 3 including guide means to guide the travel of said length of rope along said gutter assembly.

5. A gutter assembly as set forth in claim 4 wherein said guide means comprises a plurality of ring bolts.

6. A gutter assembly as set forth in claim 5 wherein one of said ring bolts is mounted along the top of said channel member with a bracket.

7. A gutter assembly as set forth in claim 6 wherein one or more of said ring bolts is mounted on said second end cap.

8. A gutter assembly as set forth in claim 7 including a cleat mounted on said assembly to facilitate the storage of the loose end of said length of rope.

9. A gutter assembly as set forth in claim 4 wherein said bracket comprises a pair of arcuate channels which form guide openings for said rope.

10. A gutter assembly as set forth in claim 9 wherein said first end cap comprises a removable end cap and said second end cap is fixed upon the end of said channel member.

11. A gutter assembly as set forth in claim 1 wherein said means to remove and re-insert includes a counterweight assembly attached to one end of said flexible strip.

12. A gutter assembly as set forth in claim 11 wherein said counterweight assembly comprises a counterweight and a length of rope connecting said counterweight to the end of said flexible strip.

13. A gutter assembly as set forth in claim 12 wherein one end of said flexible strip includes an upturned lip.

14. A gutter assembly as set forth in claim 12 wherein one end of said rope includes a hook which facilitates the attachment and removal of said rope from the end of the flexible strip.

15. A gutter assembly as set forth in claim 12 wherein said means to remove and re-insert includes a second counterweight assembly attached to the other end of said flexible strip.

16. A gutter assembly as set forth in claim 15 wherein said second counterweight assembly comprises a counterweight and a length of rope connecting said counterweight to the other end of said flexible strip.

17. A gutter assembly comprising a longitudinally extending elongated channel member having an inner sidewall, an outer sidewall, and a bottom wall connecting and spacing said inner sidewall and said outer sidewall, a removable end cap for opening one end of said channel member, and a flexible strip disposed substantially contiguous with said bottom wall of said channel member, said flexible strip slidable along said bottom wall and capable of being removed through the open end of said channel member upon removal of said end cap thereby facilitating the removal of debris from the gutter assembly which has accumulated on said flexible strip.

* * * * *